US007401692B2

(12) United States Patent
Kim

(10) Patent No.: US 7,401,692 B2
(45) Date of Patent: Jul. 22, 2008

(54) DEVICE FOR RESTRAINING THE RISE OF A STEP ROLLER OF AN ESCALATOR

(75) Inventor: Jeong Rak Kim, Incheon (KR)

(73) Assignee: Otis Elevator Company, Farmington, CT (US)

( * ) Notice: Subject to any disclaimer, the term of this patent is extended or adjusted under 35 U.S.C. 154(b) by 63 days.

(21) Appl. No.: 10/579,003

(22) PCT Filed: Nov. 26, 2004

(86) PCT No.: PCT/KR2004/003077

§ 371 (c)(1),
(2), (4) Date: May 11, 2006

(87) PCT Pub. No.: WO2005/051830

PCT Pub. Date: Jun. 9, 2005

(65) Prior Publication Data

US 2007/0051584 A1 Mar. 8, 2007

(30) Foreign Application Priority Data

Nov. 29, 2003 (KR) ..... 10-2003-0085911

(51) Int. Cl.
*B66B 23/12* (2006.01)

(52) U.S. Cl. ..... 198/332; 198/333

(58) Field of Classification Search ..... 198/332, 198/333, 323, 324
See application file for complete search history.

(56) References Cited

U.S. PATENT DOCUMENTS 4,175,652 A * 11/1979 Satou et al. ..... 198/332
4,638,901 A * 1/1987 Lunardi ..... 198/323
4,681,207 A 7/1987 Goto et al.
4,726,463 A * 2/1988 Babler ..... 198/333
5,161,668 A * 11/1992 Datema et al. ..... 198/332
5,170,875 A * 12/1992 Kubota ..... 198/328
5,435,428 A * 7/1995 Adachi et al. ..... 198/324
5,472,075 A 12/1995 Yamashita et al.
5,487,449 A 1/1996 Barrett et al.
5,992,605 A 11/1999 Haruta
6,450,316 B1 * 9/2002 Stuffel et al. ..... 198/326
6,685,003 B2 * 2/2004 Copeland et al. ..... 198/326
7,104,386 B2 * 9/2006 Ogura et al. ..... 198/334

(Continued)

FOREIGN PATENT DOCUMENTS

EP 1 338 548 A1 8/2003

(Continued)

OTHER PUBLICATIONS

PCT International Search Report for PCT/KR2004/003077, dated Feb. 25, 2005.

(Continued)

*Primary Examiner*—Douglas A. Hess

(57) ABSTRACT

A device for restraining the rise of a step roller of an escalator prevents the step roller from colliding with rails of a track in turn around areas at the top and bottom of the escalator. The device comprises: a supplementary roller, which is disposed between an outer rail and an inner rail of the track; an elastic member for biasing the supplementary roller toward the outer rail to roll thereon; and a supporting block to which the elastic member is fixed.

6 Claims, 3 Drawing Sheets

U.S. PATENT DOCUMENTS

| | | | | |
|---|---|---|---|---|
| 7,124,875 | B2 * | 10/2006 | Ogura et al. | 198/334 |
| 7,140,484 | B2 * | 11/2006 | Stuffel et al. | 198/333 |
| 7,159,705 | B2 * | 1/2007 | Ogimura et al. | 198/326 |

FOREIGN PATENT DOCUMENTS

| | | |
|---|---|---|
| GB | 16267 | 3/1911 |
| GB | 203033 | 8/1923 |
| GB | 491301 | 8/1938 |
| GB | 492715 | 9/1938 |
| GB | 549616 | 11/1942 |
| JP | 04-020495 | 1/1992 |

OTHER PUBLICATIONS

PCT Written Opinion for PCT/KR2004/003077, dated Feb. 25, 2005.

* cited by examiner

[Fig. 1]
(Prior Art)
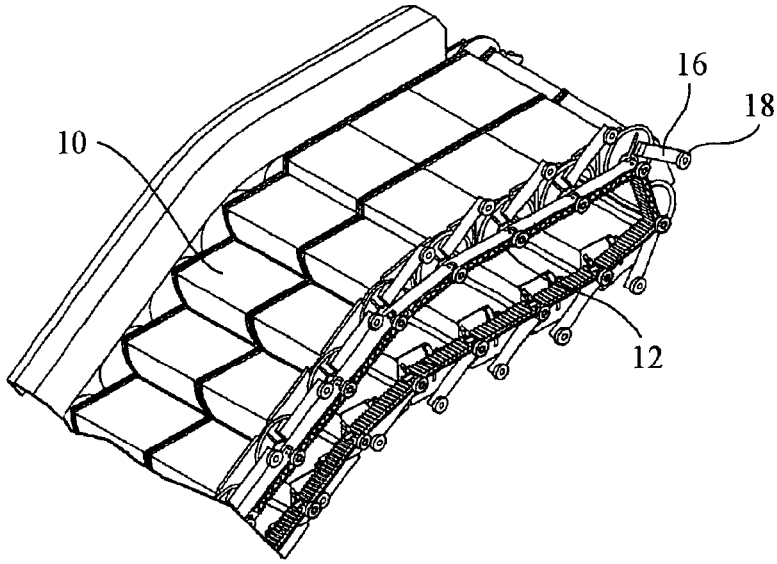
[Fig. 2]
(Prior Art)
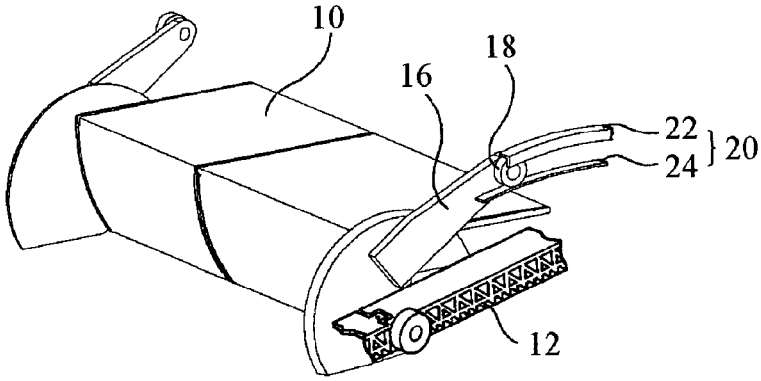
[Fig. 3]
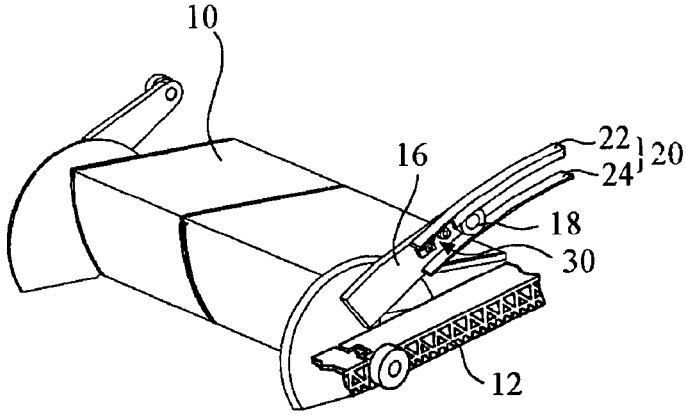

[Fig. 4]
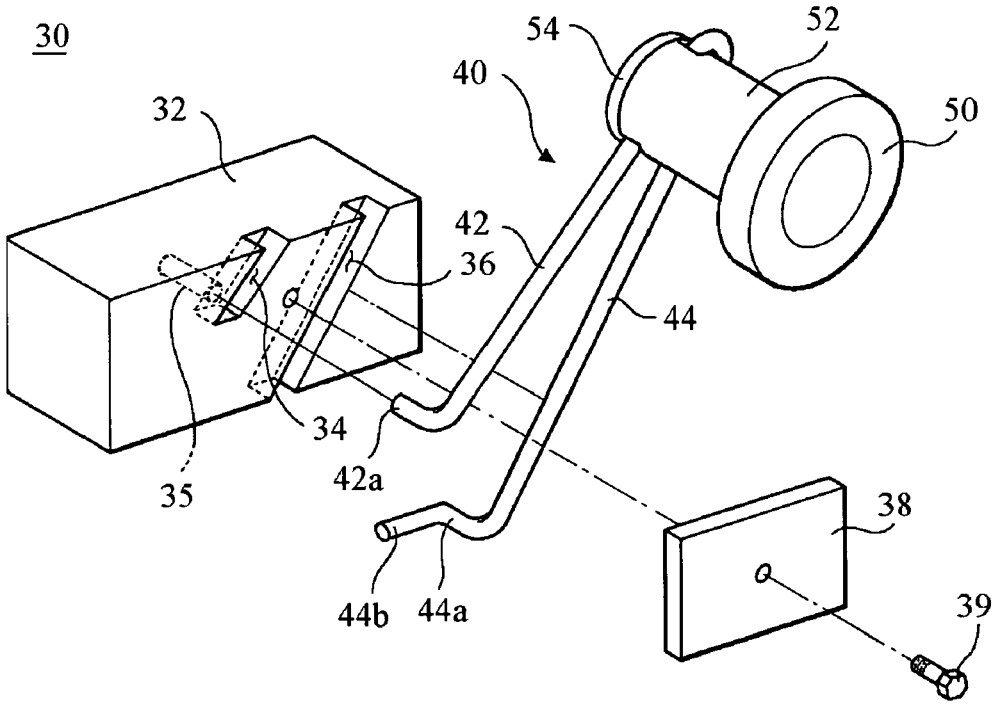
[Fig. 5]
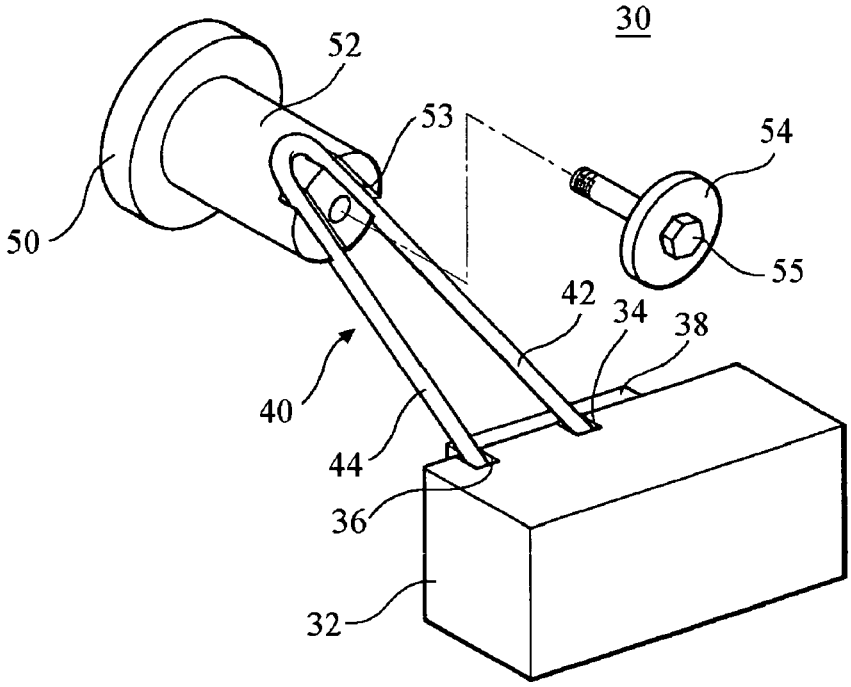

[Fig. 6]
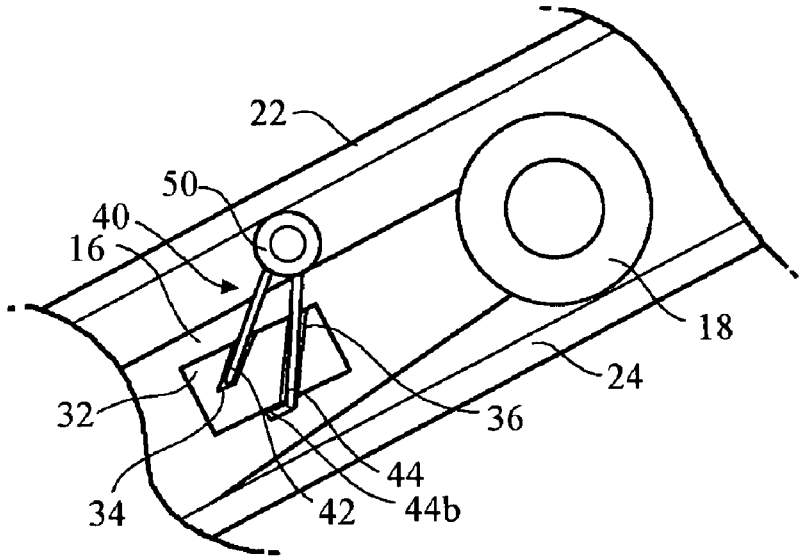
[Fig. 7]
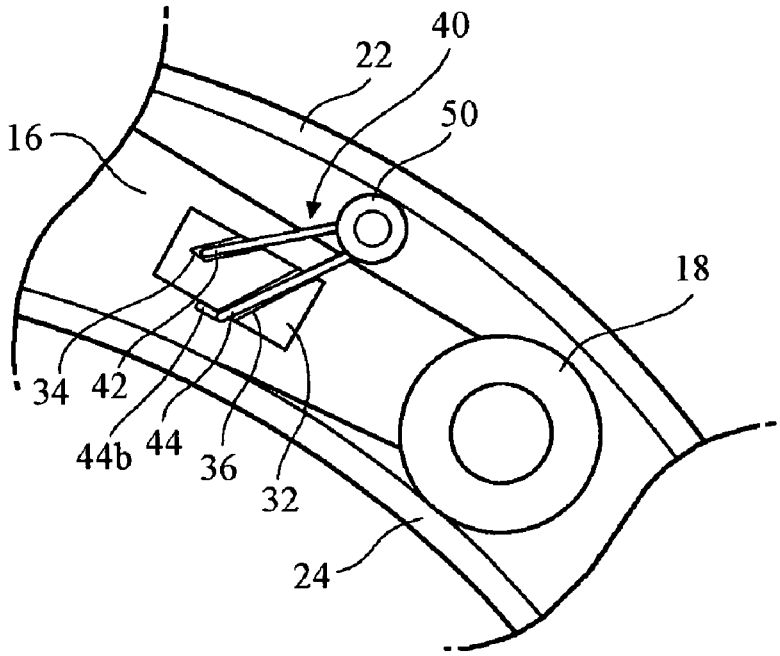

DEVICE FOR RESTRAINING THE RISE OF A STEP ROLLER OF AN ESCALATOR

TECHNICAL FIELD

The present invention generally relates to an escalator, and more particularly to a device for restraining a step roller from rising to collide with a rail of a track in turn around areas located at the top and bottom of the escalator.

BACKGROUND ART

A typical escalator includes a frame, balustrades with movable handrails, steps, a drive system and a step chain for propelling the steps. The frame includes a truss section on both left and right hand sides of the frame. Each truss section has two end sections forming landings, which are connected by an inclined midsection. The upper landing usually houses the escalator drive system or machine positioned between the trusses.

The drive system of the escalator typically consists of a step chain, a step chain drive sprocket, an axle and a drive motor. The drive motor drives the step chain to travel a continuous closed loop.

As shown in FIGS. 1 and 2, steps 10, which are attached to a step chain 12, run from one landing to the other in order to transport the passengers.

Support levers 16 are fixedly coupled to both sides of the step 10. Each support lever 16 is provided with a step roller 18, which is rotatably mounted to an end of the support lever 16. The step roller 18 guides the movement of the step 10 and further supports the same.

An escalator has a track 20 on both left and right sides, along which the step roller 18 travels a continuous closed loop. The track 20 is substantially parabolic in shape at the turn around areas, which are located under the lower and upper landings, so that the step roller 18 and the step 10 can make a 180 degree heading change at the turn around areas.

The track 20 includes an inner rail 24 and an outer rail 22 that is disposed outward of the inner rail 24. The gap between the inner rail 24 and the outer rail 22 is set to be a little larger than the diameter of the step roller 18. The outer rail 22 has a L-shape to prevent the step roller 18 from separating transversely from the track 20.

At the passenger conveying area, the step roller 18 rolls on the inner rail 24 of the track 20. Since the step 10 moves upward, the step roller 18 rises from the inner rail 24 to the outer rail 22 when the step roller 18 advances into the curved portion of the track 20 at the upper turn around area. This is due to the inertia of the moving step 10. As such, the step roller 18 collides with the outer rail 22. Then, the step roller 18 descends toward the lower landing with rolling on the outer rail 22 and returns onto the inner rail 24 at the lower turn around area.

However, the collisions of the step roller with the rails of the track cause undesired noise and vibration, thus making the passengers feel very uncomfortable. Such collisions may even lead to malfunction of the escalator.

SUMMARY OF THE INVENTION

Exemplary embodiments of the invention include a device for restraining the rise of a step roller of an escalator. The escalator includes: steps circulating a closed loop; a track having inner and outer rails and providing the circulating loop of the steps; and a step roller connected to each step and rolling along the inner rail of the track. The device of the present invention comprises: a supplementary roller, which is disposed between the outer rail and the inner rail of the track; an elastic member for connecting the supplementary roller to the step; and a supporting block, which is connected to the step and to which the elastic member is fixed.

The elastic member biases the supplementary roller toward the outer rail of the track in order to roll thereon. The elastic member is a linear spring, which has a first leg and a second leg that are bent with respect to each other by a predetermined angle.

The supporting block has first and second recesses, in which each portion of the first and second legs of the elastic member are fitted, respectively. The first and second recesses limit the deformation of the first and second legs of the elastic member to a predetermined range.

The first leg of the elastic member has a bent portion at its tip, which is pivotably inserted into the supporting block. Further, the second leg of the elastic member has a bent portion at its tip, which contacts a bottom surface of the supporting block.

DESCRIPTION OF DRAWINGS

The above object and features of the present invention will become more apparent from the following description of the preferred embodiments given in conjunction with the accompanying drawings.

FIG. 1 is a perspective view schematically showing steps and a step chain of a conventional escalator.

FIG. 2 is a perspective view showing a mounting structure of a step roller and a track of a conventional escalator.

FIG. 3 is a perspective view showing a mounting structure of a track and a device for restraining the rise of a step roller in accordance with a preferred embodiment of the present invention.

FIG. 4 is a front exploded perspective view showing a device for restraining the rise of a step roller in accordance with the preferred embodiment.

FIG. 5 is a rear perspective view showing a device for restraining the rise of a step roller in accordance with the preferred embodiment.

FIG. 6 is a side view showing an operational state of the inventive device when the step roller moves along the track at a passenger conveying area of an escalator.

FIG. 7 is a side view showing an operational state of the inventive device when the step roller moves along the track at an upper turn around area of an escalator.

DETAILED DESCRIPTION

FIG. 3 is a perspective view showing a mounting structure of a track and a device for restraining the rise of a step roller of an escalator in accordance with a preferred embodiment of the present invention.

As shown in the drawing, each step 10 is attached to a step chain 12 traveling in a continuous closed loop. Support levers 16 are fixedly coupled to both sides of the step 10. Each support lever 16 is provided with a step roller 18, which is rotatably mounted to an end of the support lever 16. The step roller 18 guides the movement of the step 10 and supports the same.

An escalator has a track 20 on both left and right sides, along which the step roller 18 travels in a continuous closed loop. The track 20 includes an inner rail 24 and an outer rail 22 that is disposed outward the inner rail 24. The gap between the inner rail 24 and the outer rail 22 is set to be a little larger than the diameter of the step roller 18.

There is provided a device 30 for restraining the step roller 18 from rising from the inner rail 24 to the outer rail 22, thus preventing it from colliding with the outer rail 22 in the turn around areas at the top and bottom of the escalator. Such device is mounted to the support lever 16 and will be described in detail hereinafter with reference to FIGS. 4 and 5.

The device 30 for restraining the rise of the step roller 18 comprises: a supplementary roller 50, which is in contact with the outer rail 22 of the track 20; an elastic member 40 for biasing the supplementary roller 50 toward the outer rail 22; and a supporting block 32, which is attached to the support lever 16 to support the elastic member 40.

The elastic member 40 is a linear spring, which is configured to have a first leg 42 and a second leg 44 that are bent with respect to each other by a predetermined angle in a "Λ" shape. The supporting block 32 has first and second recesses 34 and 36 on its front surface, in which the first and second legs 42 and 44 of the elastic member 40 are seated, respectively. The first recess 34 extends downward from the top end of the supporting block 32 by a specific length. The second recess 36 extends downward from the top end of the supporting block 32 to the bottom end thereof. These recesses 34 and 36 are slanted at a predetermined angle toward the step roller 18.

The first leg 42 of the elastic member 40 is provided with a bent portion 42*a* at its tip. The bent portion 42*a* of the first leg 42 is pivotably inserted into an insertion hole 35, which is formed at an end of the first recess 34 of the supporting block 32.

The second leg 44 of the elastic member 40 is provided with a first bent portion 44*a* and a second bent portion 44*b* at its tip. The first bent portion 44*a* extends rearward of the supporting block 32 and is in contact with the bottom surface of the supporting block 32. The second bent portion 44*b* extends from the end of the first bent portion 44*a* and is in contact with the bottom surface of the supporting block 32 so as to serve as a base point of the elastic member 40.

The first and second recesses 34 and 36 of the supporting block 32 are a little wider than the first and second legs 42 and 44 of the elastic member 40. This is so that the elastic member 40 can be deformed within a limited range, which will be described later.

A cover 38 is coupled to the front surface of the supporting block 32 by a fastening means, such as a bolt 39. This is to cover the first and second recesses 34 and 36 and prevent the first and second legs 42 and 44 of the elastic member 40 from being separated therefrom.

As shown in FIG. 5, the elastic member 40 is coupled to a supplementary roller-supporting member 52 at a portion adjacent to the junction between the first and second legs 42 and 44. Receiving slots 53 are formed at the rear surface of the supporting member 52, in which the first and second legs 42 and 44 of the elastic member 40 are seated. Also, a cover 54 is attached to the rear surface of the supporting member 52 by a fastening means, such as a bolt 55. This is to prevent the legs 42 and 44 of the elastic member 40 from being separated from the receiving slots 53.

The operational effects of the device for restraining the rise of the step roller according to the present invention will be described hereinafter based on the assumption that the escalator moves upward.

As shown in FIG. 6, when the step roller 18 moves along the linear portion of the track 20 at the passenger conveying area, the step roller 18 rolls on the inner rail 24 of the track 20. Further, the supplementary roller 50 is biased toward the outer rail 22 of the track 20 by the elastic member 40 and rolls on the outer rail 22.

As shown in FIG. 7, when the ascending step roller 18 arrives at the upper landing and advances into the curved portion of the track 20 at the upper turn around area, the step roller 18 rises toward the outer rail 22 of the track 20. This is due to the inertia force, and the supplementary roller 50, which is in contact with the outer rail 22, is subjected to the reactional force to the inertia force. Therefore, the elastic member 40 is deformed restrictively in such a manner that the first leg 42 pivots within the first recess 34 of the supporting block 32 on the axis of the bent portion 42*a* inserted into the insertion hole 35. Further, the second leg 44 moves within the second recess 36 with the first and second bent portions 44*a* and 44*b* contacting the bottom surface of the supporting block 32. At the same time, the restoring force against the force acting on the step roller 18 and the elastic member 40 is generated between the second bent portion 44*b* of the second leg 44 of the elastic member 40 and the supporting block 32.

When the restoring force of the elastic member 40 is sufficient to overcome the rising force acting on the step roller 18, the step roller 18 stops rising and returns to its original position (i.e., onto the inner rail 24 of the track 20). Accordingly, the step roller 18 is restrained from colliding with the outer rail 22 of the track 20.

Although the restoring force of the elastic member 40 becomes gradually weakened due to repeated operations, the shock and noise caused by the collision of the step roller 18 with the track 20 rarely occur, if any.

By diversely adjusting the material, the rigidity or elasticity of the elastic member 40, the collision of the step roller 18 with the outer rail 22 of the track 20 at the turn around area may be completely restrained as the present embodiment, or may occur so gently that there is very little shock.

As described above in detail, exemplary embodiments of the invention restrain a step roller from rising toward an outer rail of a track at turn around areas of an escalator by a supplementary roller biased toward the outer rail of the track by an elastic member. This can prevent the shock and noise caused by the collision, thus providing the passengers with comfort and stability.

The present invention may be embodied in other specific forms without departing from its essential characteristics. The described embodiments are to be considered in all respects only as illustrative and not restrictive. The scope of the invention is, therefore, indicated by the appended claims, rather than by the foregoing description. All changes, which come within the equivalent meaning and range of the claims, are to be embraced within their scope.

The invention claimed is:

1. A device for restraining rise of a step roller of an escalator, the escalator including steps circulating a closed loop, a track having inner and outer rails and providing the circulating loop of the steps, and a step roller connected to each step and rolling along the inner rail of the track, the device comprising:

a supplementary roller disposed between the outer rail and the inner rail of the track; and an elastic member for connecting the supplementary roller to the step, wherein the elastic member biases the supplementary roller toward the outer rail of the track to roll thereon, such that the rise of the step roller toward the outer rail is restrained.

2. The device of claim 1, wherein the device further comprises a supporting block which is connected to the step and to which the elastic member is fixed.

3. The device of claim 1, wherein the elastic member is a linear spring having a first leg and a second leg, the first leg and the second leg being bent with respect to each other by a predetermined angle; and the supporting block has first and second recesses, each portion of the first and second legs of the elastic member being respectively fitted to the first and second recesses to thereby limit deformation of the first and second legs of the elastic member to a predetermined range.

4. The device of claim 3, wherein the first leg of the elastic member has a bent portion at its tip, the tip being pivotably inserted into the supporting block; and the second leg of the elastic member has a bent portion at its tip, the tip being configured to contact a bottom surface of the supporting block.

5. The device of claim 3, wherein a cover is mounted to the supporting block to prevent the first and second legs of the elastic member from being separated from the first and second recesses of the supporting block.

6. The device of claim 3, wherein the device further comprises a member for supporting the supplementary roller, the member having a recess in which a portion adjacent to the junction between the first and second legs of the elastic member is fitted, and a cover which covers the recess of the member.

* * * * *